US007418774B2

(12) United States Patent
Joseph et al.

(10) Patent No.: US 7,418,774 B2
(45) Date of Patent: Sep. 2, 2008

(54) METHOD OF USING AN AUTOMATIC RIVET LOADING MODULE

(75) Inventors: James W. Joseph, Mississauga (CA); Wim Bouman, Toronto (CA)

(73) Assignee: Acument Intellectual Properties, LLC, Troy, MI (US)

( * ) Notice: Subject to any disclaimer, the term of this patent is extended or adjusted under 35 U.S.C. 154(b) by 501 days.

(21) Appl. No.: 11/294,122

(22) Filed: Dec. 5, 2005

(65) Prior Publication Data

US 2006/0080823 A1 Apr. 20, 2006

Related U.S. Application Data

(62) Division of application No. 10/784,675, filed on Feb. 23, 2004, now Pat. No. 7,020,955.

(60) Provisional application No. 60/449,744, filed on Feb. 24, 2003.

(51) Int. Cl.
*B23Q 7/10* (2006.01)

(52) U.S. Cl. ..... 29/434; 29/524.1; 29/809; 29/812.5; 72/391.6; 221/270; 221/277; 221/312 A

(58) Field of Classification Search ..... 29/434, 29/524.1, 798, 809, 812.5; 72/391.6; 221/75, 221/89, 182, 168, 270, 277, 281, 312 A
See application file for complete search history.

(56) References Cited

U.S. PATENT DOCUMENTS

| | | | | |
|---|---|---|---|---|
| 2,706,039 | A | | 4/1955 | Springate |
| 3,557,597 | A | | 1/1971 | Heslop et al. |
| 3,828,603 | A | | 8/1974 | Sheffield et al. |
| 3,886,783 | A | | 6/1975 | Hirsch |
| 4,005,519 | A | | 2/1977 | Di Maio et al. |
| 4,047,281 | A | | 9/1977 | Di Maio et al. |
| 4,128,155 | A | | 12/1978 | Gerhart |
| 4,388,753 | A | | 6/1983 | Brookes |
| 4,901,431 | A | * | 2/1990 | Gast ..... 29/707 |
| 5,170,923 | A | | 12/1992 | Dear et al. |
| 5,236,341 | A | | 8/1993 | Stafford |
| 5,813,114 | A | | 9/1998 | Blacket et al. |
| 6,347,449 | B1 | | 2/2002 | Calkins et al. |

FOREIGN PATENT DOCUMENTS

EP 0 399 798 A2 11/1990

* cited by examiner

*Primary Examiner*—Jermie E Cozart
(74) *Attorney, Agent, or Firm*—Trexler, Bushnell, Giangiorgi, Blackstone & Marr, Ltd.

(57) ABSTRACT

An automatic rivet loading module which includes a pusher mechanism, a gripper mechanism, a mandrel receptacle, mechanisms for moving mandrels in the mandrel receptacle, and a tool activation device. The gripper mechanism receives a rivet, and a mandrel is moved through the rivet such that the rivet threads onto the mandrel. The gripper mechanism moves out of the way while the pusher mechanism pushes the mandrel down. The pusher mechanism then retracts, and the gripper mechanism closes and is ready to receive another rivet. This process is repeated until the mandrel is full of rivets. The mandrel receptacle is rotatable such that the loaded mandrel swings to a position under the tool activation device to be loaded into a rivet tool. As the loaded mandrel is swung under the tool activation block, a new mandrel is swung under the gripper mechanism, in position for loading with rivets.

8 Claims, 19 Drawing Sheets

METHOD OF USING AN AUTOMATIC RIVET LOADING MODULE

RELATED APPLICATION (PRIORITY CLAIM)

This patent application is a divisional of U.S. patent application Ser. No. 10/784,675, filed Feb. 23, 2004, now U.S. Pat. No. 7,020,955 and entitled "Automatic Rivet Loading Module", which claims the benefit of U.S. Provisional Application Ser. No. 60/449,744, filed Feb. 24, 2003.

BACKGROUND

This invention generally relates to tools and methods for loading rivets into a rivet gun, and more specifically relates to an automatic rivet loading device and a method of automatically loading rivets.

A speed rivet is a tubular fastener consisting of a flange and a stem. The fastener is placed on a mandrel, which is a wire with a bulb on the end. The speed rivet is strung on the mandrel with the stem directed towards the bulb of the mandrel. The rivet tool is a device that holds the mandrel and pulls the mandrel through the rivet, causing the rivet to expand in diameter. The expansion process causes the rivet to expand in a hole in a workpiece, causing the components to lock together. The significance of the speed rivet is that it can be used and installed from one side of the assembly. The speed rivet is also special in that it does not incorporate a break stem which leaves part of the broken off mandrel in the rivet. A typical rivet tool holds a string of up to 60 rivets on one 20 inch long mandrel, and as one rivet is "broached" at the nose of the gun, the next rivet is moved up, ready to use. Hence, a typical rivet tool needs to be reloaded by stringing a new load of rivets on the mandrel.

Despite the fact that it is advantageous to be able to load rivets into a rivet gun, especially in the case where the rivet gun is a manual tool, the methods which are typically used to insert rivets into a rivet gun are time consuming for the operator. Typical methods which have been used to load rivets into a rivet gun have been unsuccessful due to one or more of the following, depending on the method: the high cost of replacement parts; the high maintenance time and high custom component costs; the high maintenance down time of the tooling; the long length of time it takes to reload the rivet gun; the weight of the tool is too heavy and is at the top end of ergonomic specifications; and the distance from the reload station to the placing tool is too great.

OBJECTS AND SUMMARY

An object of an embodiment of the present invention is to provide a rivet loading module which is fully automatic, highly reliable, lightweight and very fast.

Another object of an embodiment of the present invention is to provide a rivet loading module which allows twelve inches of rivets (such as forty to sixty rivets, depending on length) to be inserted into a rivet tool in four to six seconds.

Another object of an embodiment of the present invention is to provide a rivet loading module which allows an operator to make more joint fastenings in a given amount of time, compared to a typical rivet loading mechanism.

Briefly, and in accordance with at least one of the foregoing objects, an embodiment of the present invention provides an automatic rivet loading module which includes a pusher mechanism, a gripper mechanism, a mandrel receptacle, mechanisms for moving mandrels in the mandrel receptacle, and a tool activation device or block. The gripper mechanism is configured to receive a rivet, and a mandrel is moved in the mandrel receptacle through the rivet such that the rivet threads onto the mandrel. The gripper mechanism is configured to move out of the way while the pusher mechanism pushes the mandrel down. The pusher mechanism then retracts, the gripper mechanism closes and is ready to receive another rivet. This process is repeated until the mandrel is full of rivets. The mandrel receptacle is rotatable such that the loaded mandrel swings to a position under a tool activation block to be reloaded into the rivet tool. As the loaded mandrel is swung under the tool activation block, a new, empty mandrel is swung under the gripper mechanism, position for loading with rivets using the gripper and pusher mechanisms.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
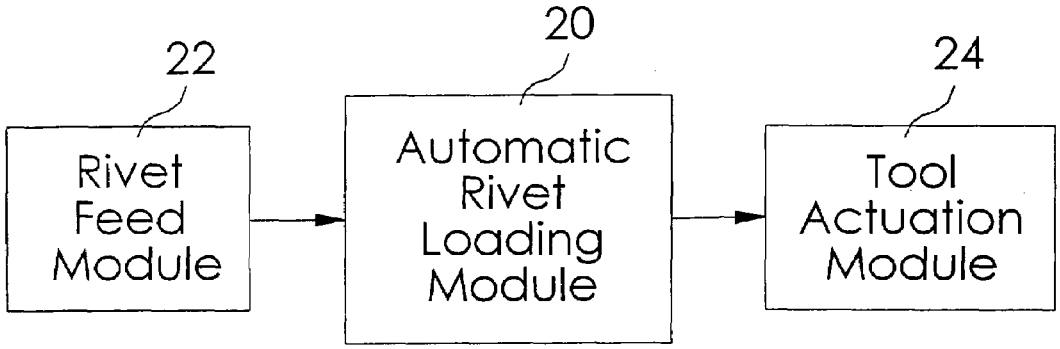
FIG. 1 is a block diagram of a system which incorporates an automatic rivet loading module which is in accordance with an embodiment of the present invention.

While the present invention may be susceptible to embodiment in different forms, there is shown in the drawings, and herein will be described in detail, an embodiment thereof with the understanding that the present description is to be considered an exemplification of the principles of the invention and is not intended to limit the invention to that as illustrated and described herein.

Figure 2:
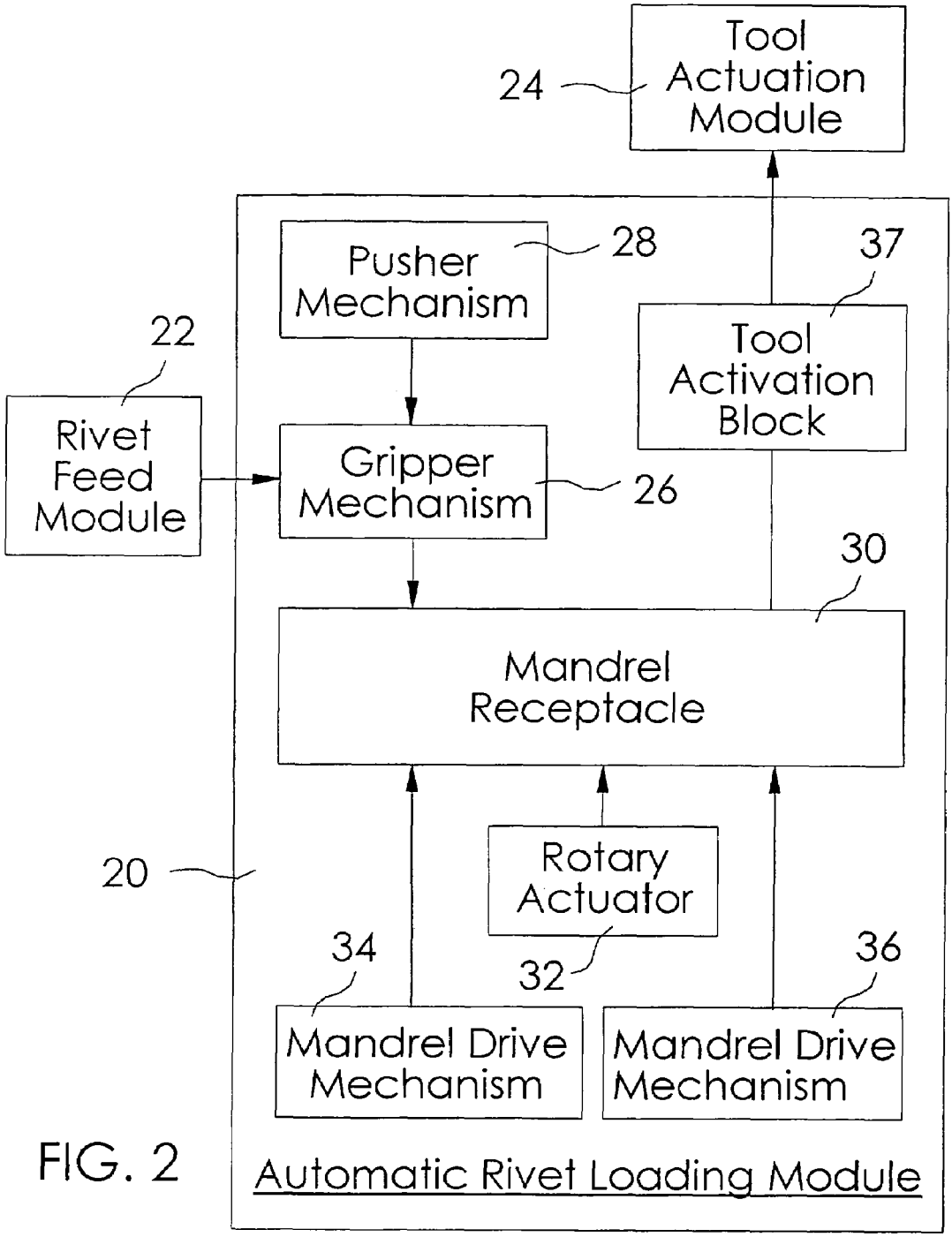
FIG. 2 is a block diagram similar to FIG. 1, showing the automatic rivet loading module in more detail.

The automatic rivet loading module 20 shown in the FIGURES is in accordance with an embodiment of the present invention, and as shown in FIGS. 1 and 2, is configured to operate in connection with a rivet feed module 22 and a tool actuation module 24. The three modules can exist in a common cabinet, or each module can work independently and be interrelated via electrical, pneumatic, and/or blow tube connections. The automatic rivet loading module 20 is fully automatic, highly reliable, lightweight and very fast. It is preferably configured to provide that twelve inches of rivets (such as forty to sixty rivets, depending on length) can be inserted into a rivet tool (i.e., in a rivet actuation module) in four to six seconds. As such, the automatic rivet loading module allows an operator to make more joint fastenings in a given amount of time, compared to a typical rivet loading mechanism. Additionally, the rivet loading module is configured such that a mandrel can be loaded with rivets while the rivet gun is being used elsewhere.

As shown in FIG. 2, the automatic rivet loading module 20 includes a gripper mechanism 26, a pusher mechanism 28, a mandrel receptacle 30, a rotary actuator 32 for rotating the mandrel receptacle 30, mandrel drive mechanisms 34, 36 for moving mandrels within the mandrel receptacle 30, and a tool activation device or block 37.

Figure 3:
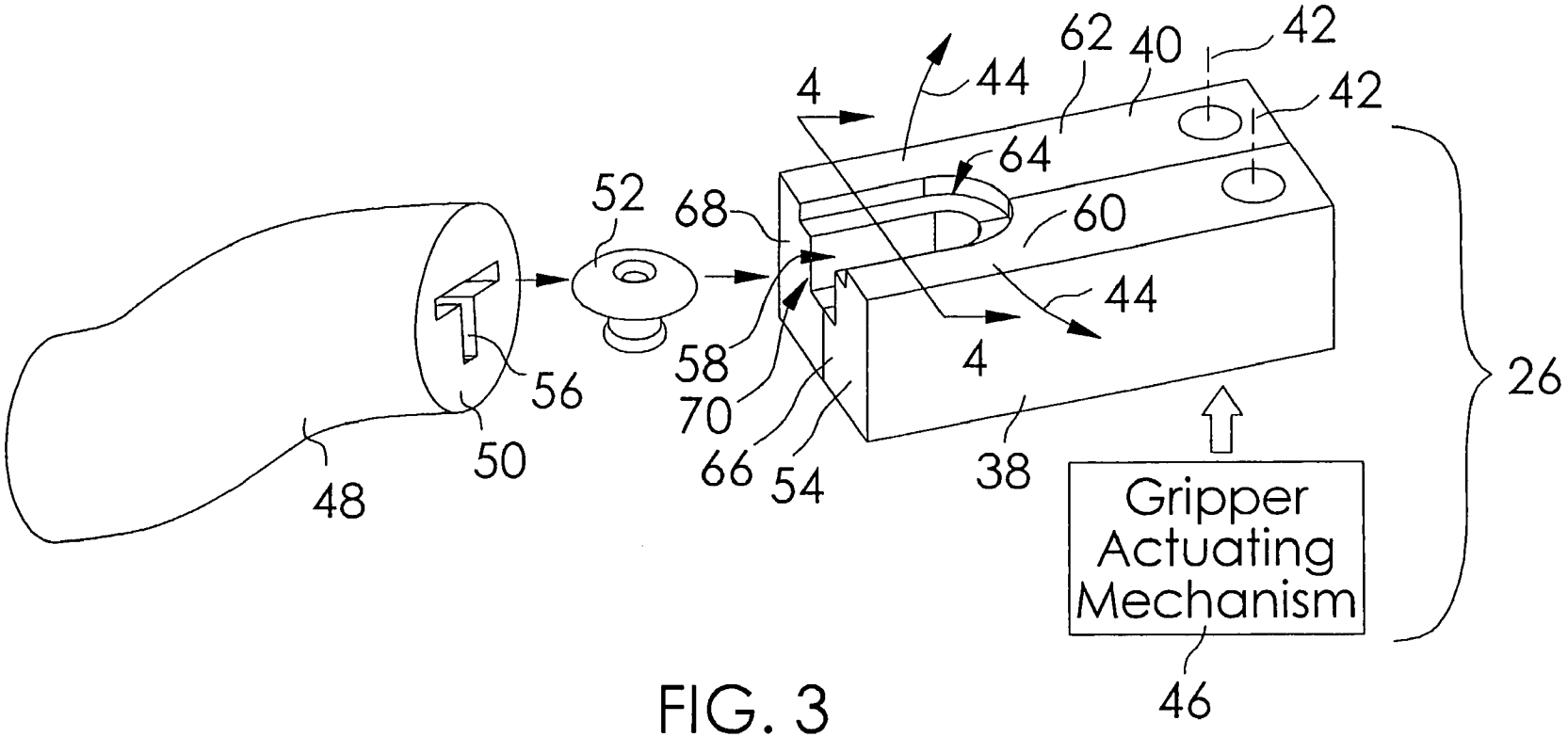
FIG. 3 is a perspective view of a rivet being fed from the end of a hose to a gripper mechanism of the automatic rivet loading module.

The automatic rivet loading module 20, and specifically the gripper mechanism 26, is configured to receive rivets from a rivet feed mechanism or rivet feed module 22, one rivet at a time. As shown in FIG. 3, the gripper mechanism 26 consists of two gripper components 38, 40 which are configured to pivot relative to each other, such as about axes 42 shown in FIG. 3 (wherein the pivoting is represented in FIG. 3 using arrows 44). A gripper actuating mechanism 46 is preferably associated with the gripper components 38, 40, and is configured to facilitate pivoting of the gripper components 38, 40 relative to each other, at the appropriate times in the overall rivet loading process (to be described in more detail later herein). As shown in FIG. 3, each of the gripper components 38, 40 may be provided in the form of a rectangular block, although other shapes and configurations may be used.

Preferably, the rivet feed module 22 is configured to feed rivets to the gripper mechanism 26 one rivet at a time. As shown in FIG. 3, the rivet feed module 22 may include a hose 48, such as a twenty foot hose made of a relatively soft urethane plastic. The end 50 of the hose 48 through which the rivets 52 exit may be positioned twenty thousandths of an inch away from the side 54 of the gripper mechanism 26. Preferably, the hose 48 is extruded, and a desired shape throughbore 56 is formed in the hose 48, wherein the throughbore 56 generally corresponds to the shape of the rivets 52 to be fed to the automatic rivet loading module 20 using the rivet feed module 22. Preferably, the rivet feed module 22 is configured to air feed rivets 52 one at a time to the gripper mechanism 26. While the end portion of a hose 48 is shown in FIG. 3, other types of rivet feed modules may be used in connection with the present invention.

Figure 4:
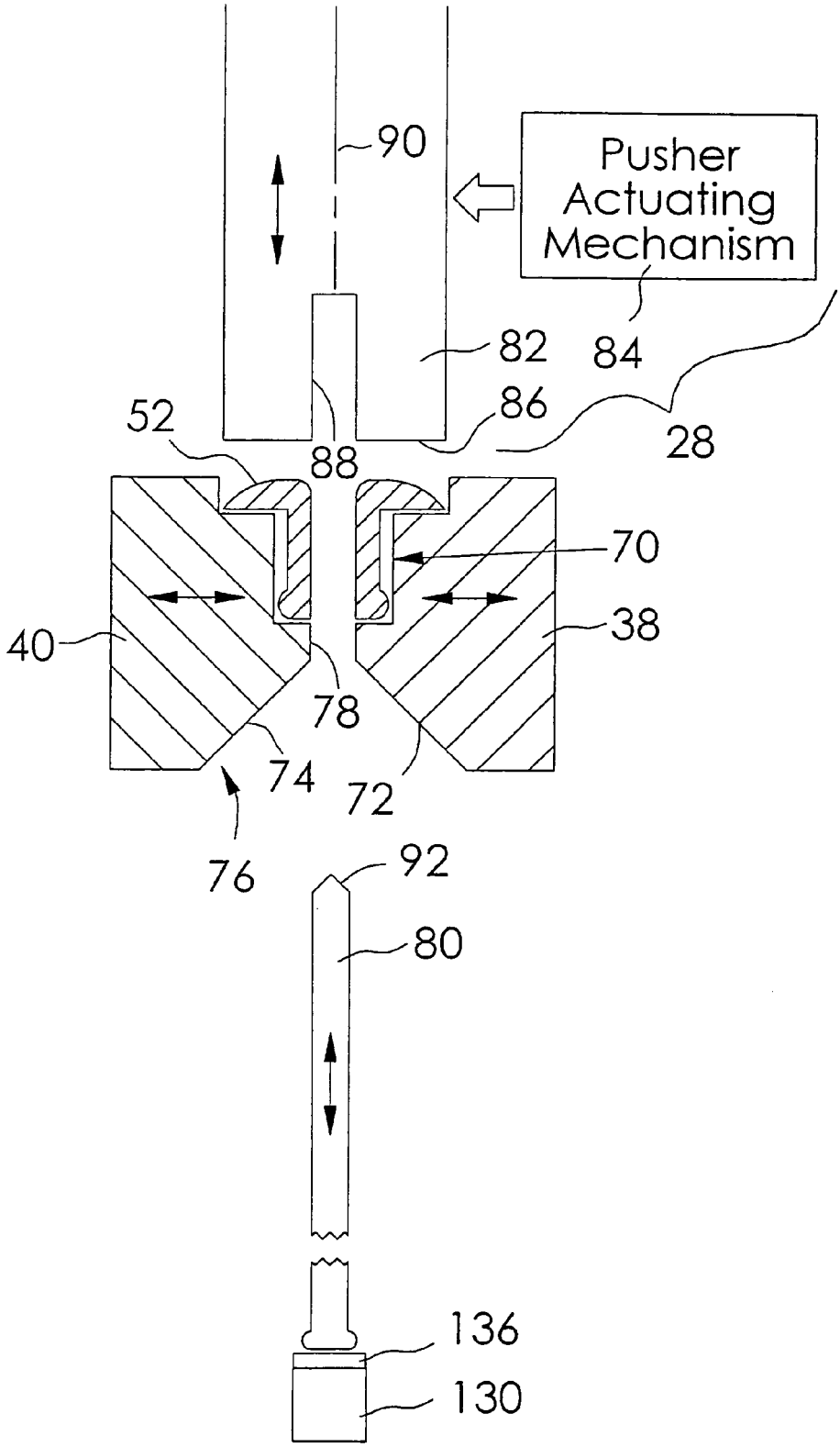
FIG. 4 is a view showing gripper components in cross section and showing a rivet retained thereby, said FIGURE also showing a pusher and the end of a mandrel.
Figure 5:
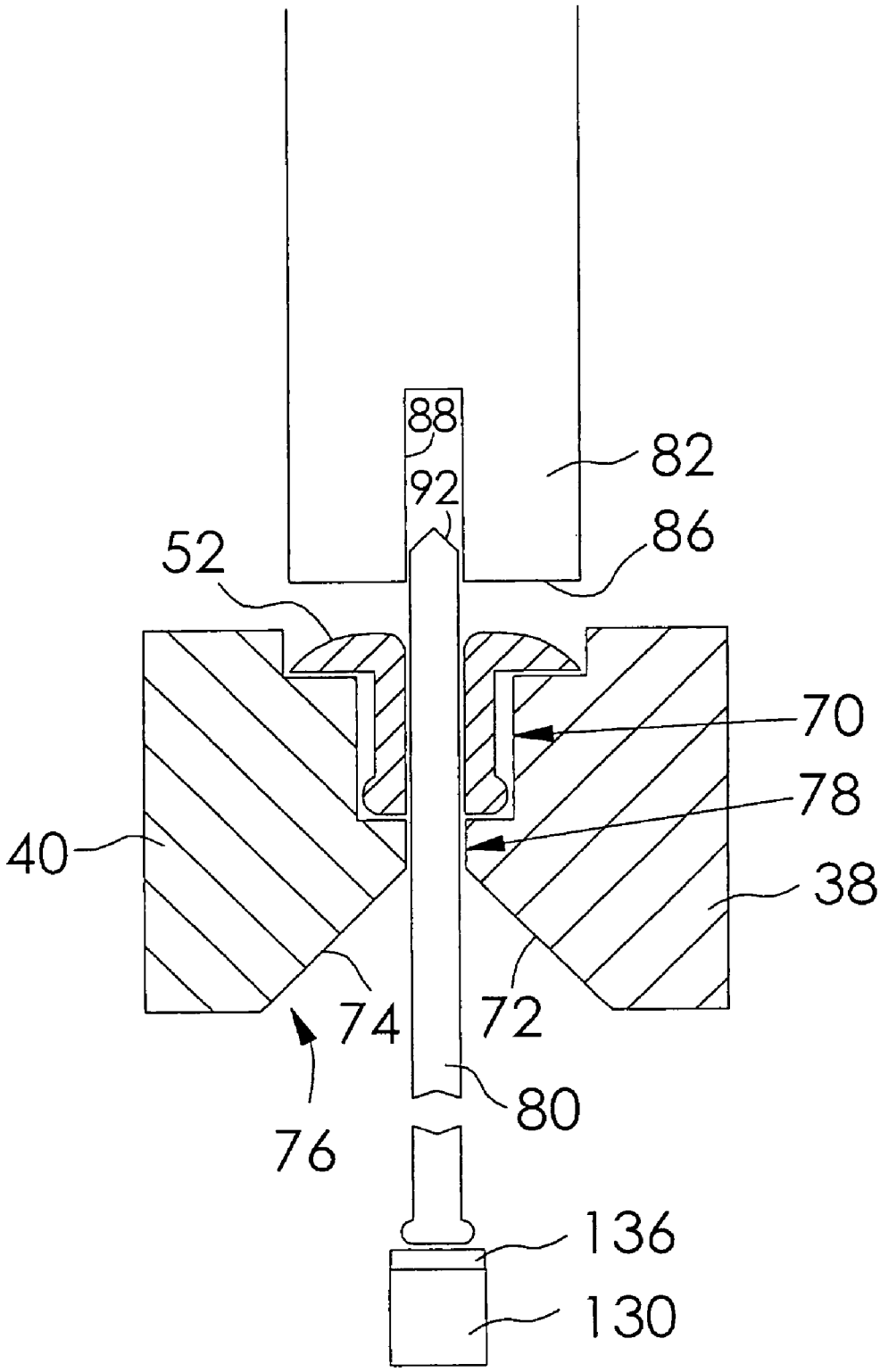
FIG. 5 is a view similar to FIG. 4, but showing the mandrel pushed up.

As shown in FIGS. 3-5, each gripper component 38, 40 includes a cut out or profile such that, when the gripper components are pivoted together, they provide a receptacle 58 which is shaped to receive, and retain, a rivet 52 from the rivet feed module 22. More specifically, as shown, a top edge 60, 62 of each of the gripper components 38, 40 may provide a cut out which, when the gripper components are pivoted together, define a U-shaped cut out 64. A side edge 66, 68 of each of the gripper components 38, 40 may provide a cut out which, when the gripper components are pivoted together, define a T-shaped cut out 70 (the T-shaped cut out 70 is clearly seen in FIGS. 4, 5 and 9). Regardless, preferably the gripper components 38, 40 are configured such that, when they are pivoted together, they can receive and retain a rivet 52.

FIGS. 4-9 show the gripper components 38, 40 in cross section, along line 4-4 of FIG. 3. As shown, preferably each of the gripper components 38, 40 includes an inclined surface 72, 74 such that when the gripper components 38, 40 are pivoted together (see FIGS. 4, 5 and 9), the incline surfaces 72, 74 define a lead cone area 76. Preferably, a space exists between the gripper components 38, 40 (when the gripper components 38, 40 are pivoted together), and the space defines a guide tube 78 which is disposed between the rivet receptacle 58 and the lead cone 76. The guide tube 78 is wide enough to allow a mandrel 80 to pass therethrough (see the progression from FIG. 4 to FIG. 5), as will be described more fully later herein.

Figure 6:
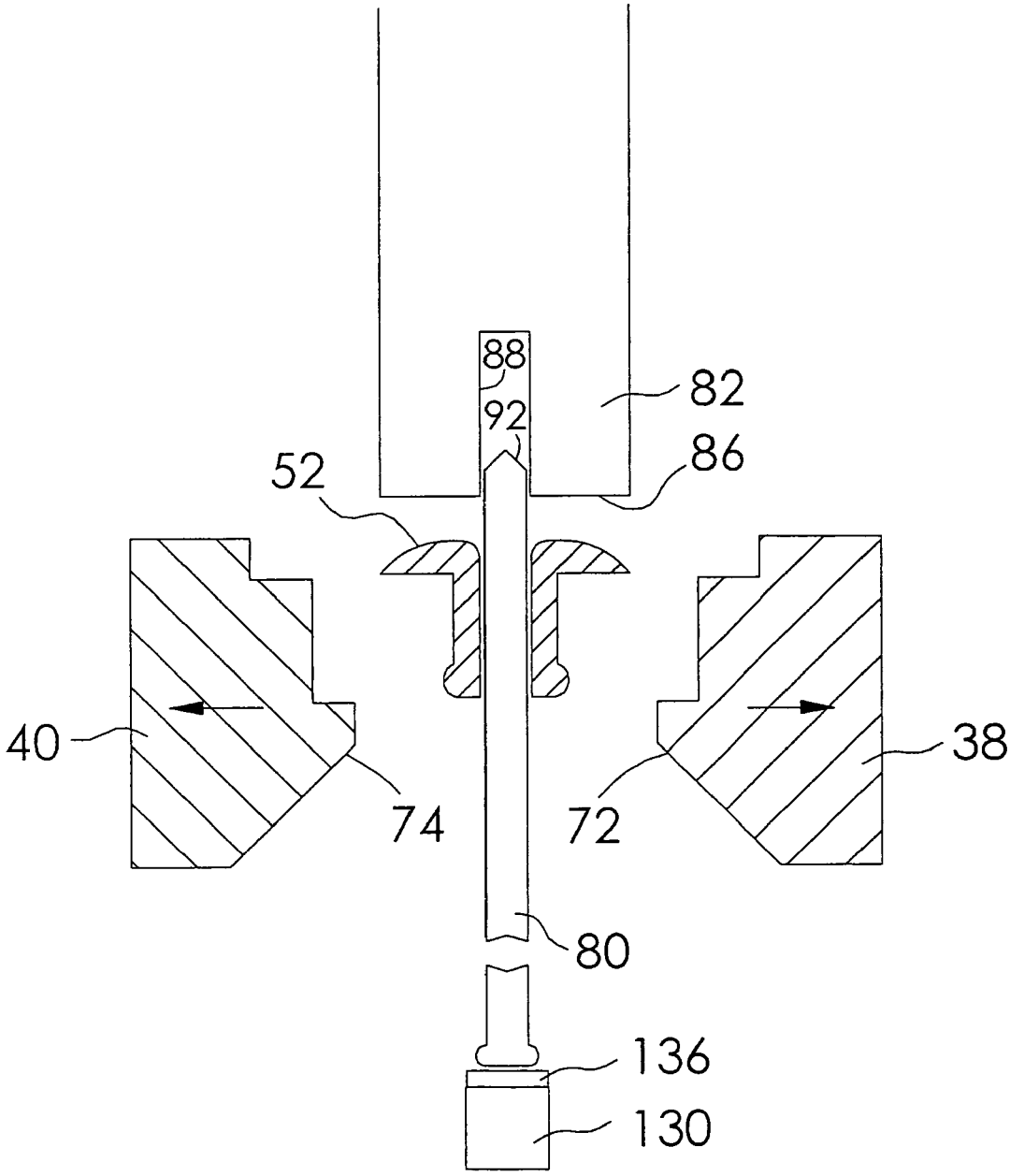
FIG. 6 is a view similar to FIG. 5, but showing the gripper components opened (i.e., pivoted away from each other)
Figure 7:
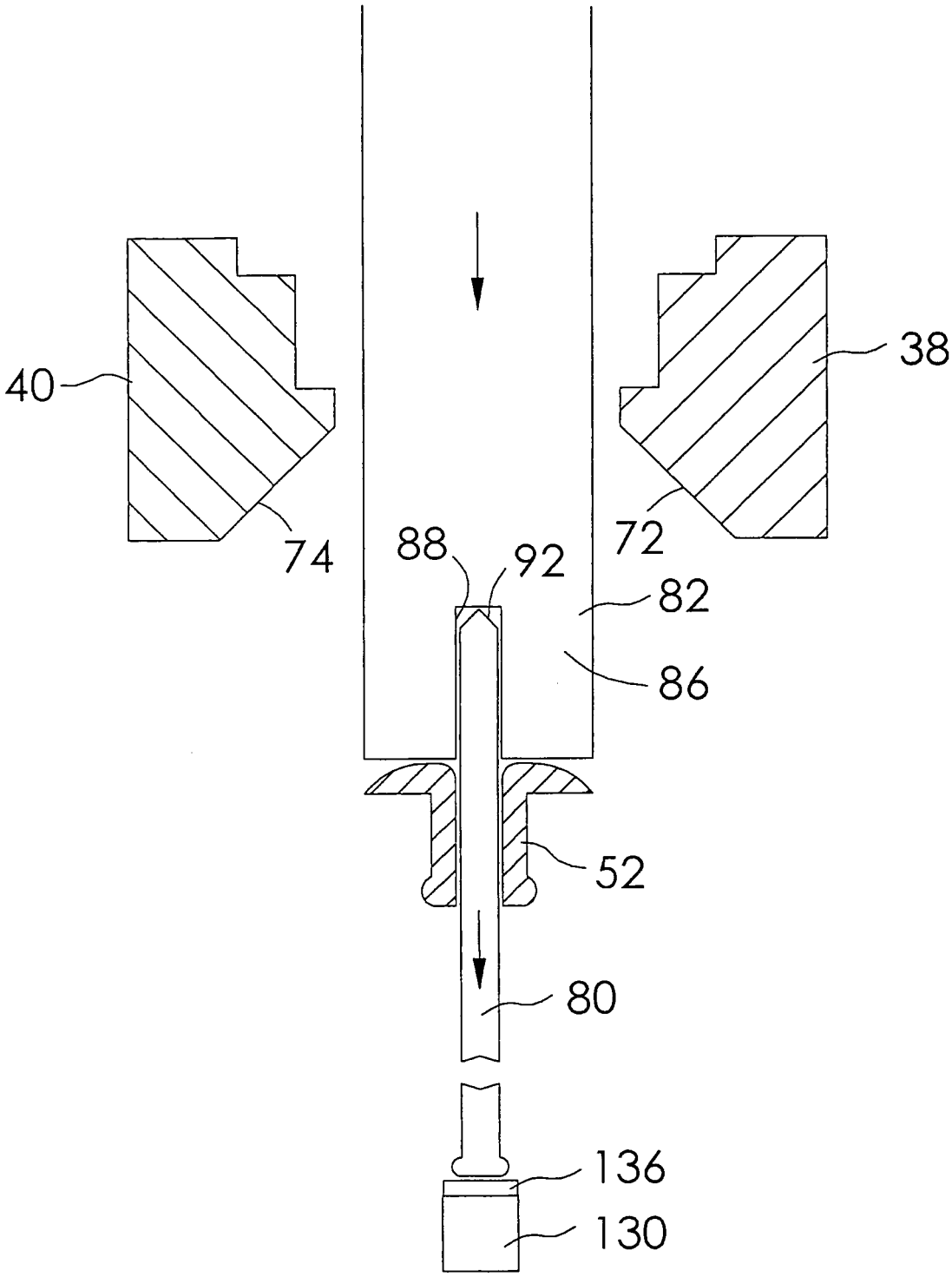
FIG. 7 is a view similar to FIG. 6, but showing the pusher pushing down the mandrel and rivet.

As shown in FIG. 4 (see also FIGS. 5-9), the pusher mechanism 28 preferably consists of a pusher 82 and a pusher actuating mechanism 84, such as an air cylinder, which is operably associated with the pusher 82. An end 86 of the pusher 82 includes a profile which provides a recess 88, and the pusher actuating mechanism 84 is configured to translate the pusher 82 back and forth along its longitudinal axis 90 (see FIG. 4 which identifies the axis 90), i.e., in an up and down direction as shown in FIGS. 5-9. As will be described more fully later herein, the recess 88 in the end 86 of the pusher 82 is configured to receive the end 92 of a mandrel 80 when the pusher 82 is moved in a downward direction as shown in FIGS. 5-7.

Figure 10:
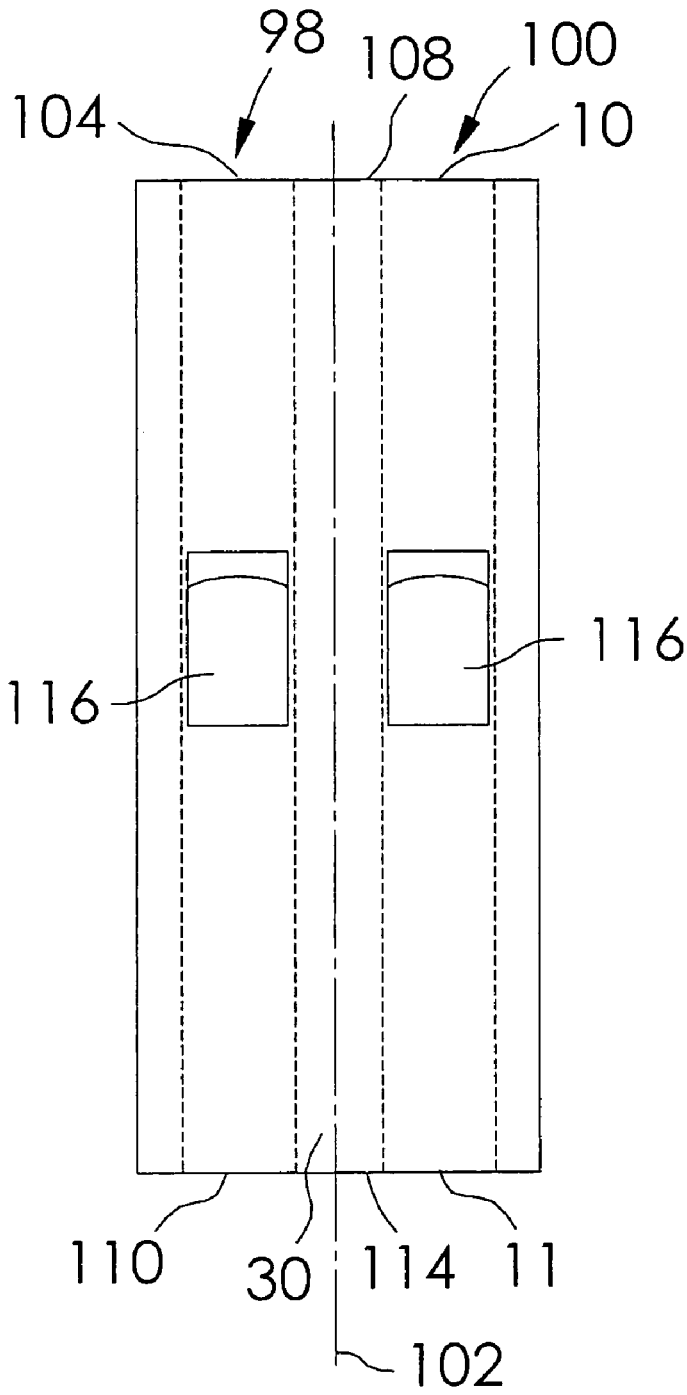
FIG. 10 is a front view of the mandrel receptacle of the automatic rivet loading module shown in FIG. 2.

As shown in FIG. 10, preferably the mandrel receptacle 30 is shaped generally as a rectangular block, but other shapes can be used. For ease of manufacture, the mandrel receptacle 30 may be provided in the form of two like components (see FIG. 11) which are secured together. Alternatively, a one piece construction can be used. Preferably, the mandrel receptacle 30 includes two longitudinal chambers 98, 100 therein, each configured to receive and retain a mandrel, as will be described more fully later herein. Preferably, the two longitudinal chambers 98, 100 are identical, and the mandrel receptacle 30 is symmetrical about its longitudinal, central axis 102. Each chamber extends from a hole 104 at the top 108 of the mandrel receptacle 30 to a hole 110 at the bottom 114 of the mandrel receptacle 30.

Figure 12:
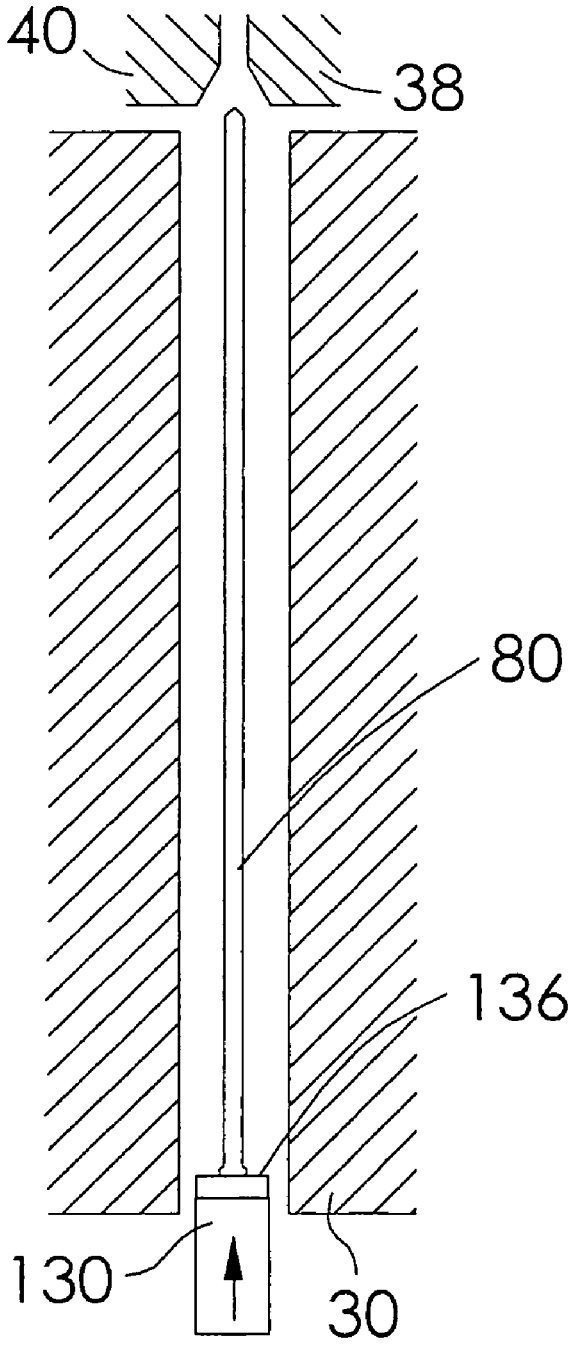
FIG. 12 is a cross sectional view showing a mandrel disposed in a chamber in the mandrel receptacle and showing the gripper components disposed above the chamber.
Figure 13:
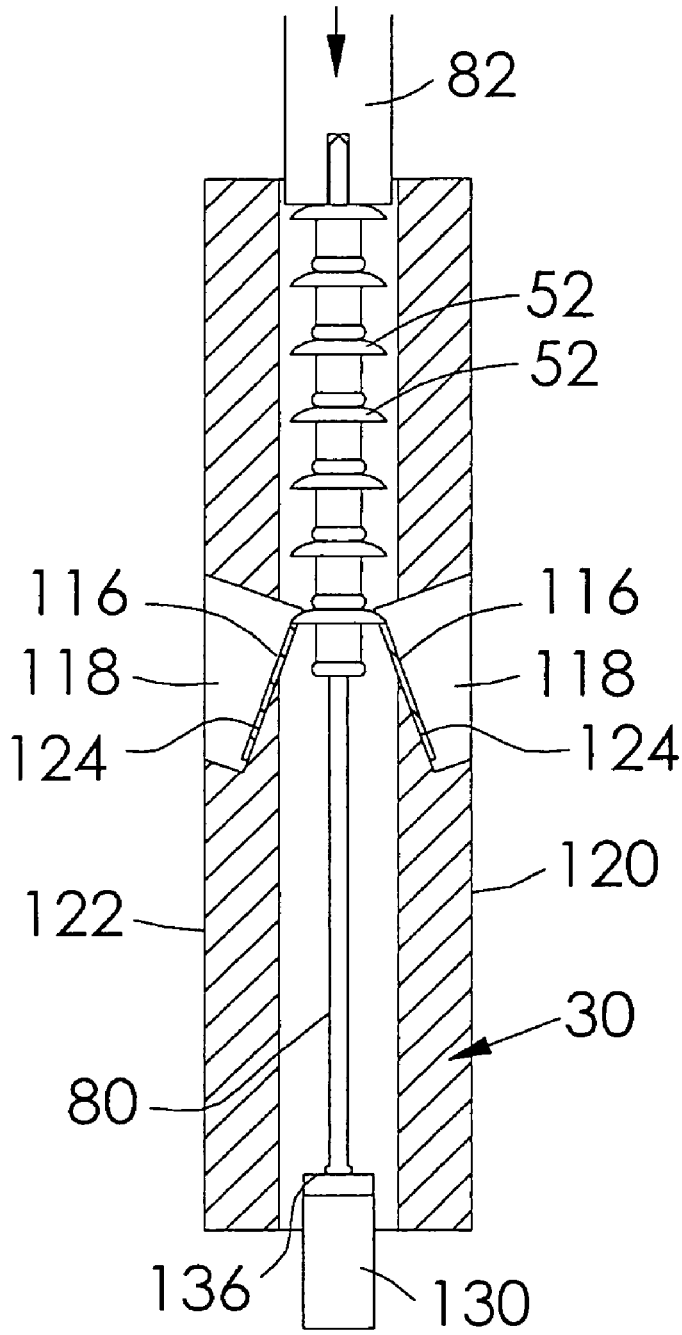
FIG. 13 is a cross sectional view similar to FIG. 12, but showing the pusher pushing down on a stack of rivets.

Rivet retaining structure is provided in each chamber, wherein the rivet retaining structure is configured to prevent the travel of rivets therepast, along a mandrel, in the respective chamber in the mandrel receptacle. The rivet retaining structure may consist of spring blades 116. Specifically, as shown in FIGS. 10, 11, 13 and 14 (the spring blades have been left out of FIG. 12 for clarity), two openings 118 may be provided in both the front 120 and back 122 of the mandrel receptacle 30 (four openings total), wherein each opening 118 provides an inclined surface 124 to which is attached a spring blade 116. As shown in FIG. 13, each spring blade 116 extends into the respective chamber and is configured to prevent rivets 52 from sliding therepast along a mandrel.

Figure 11:
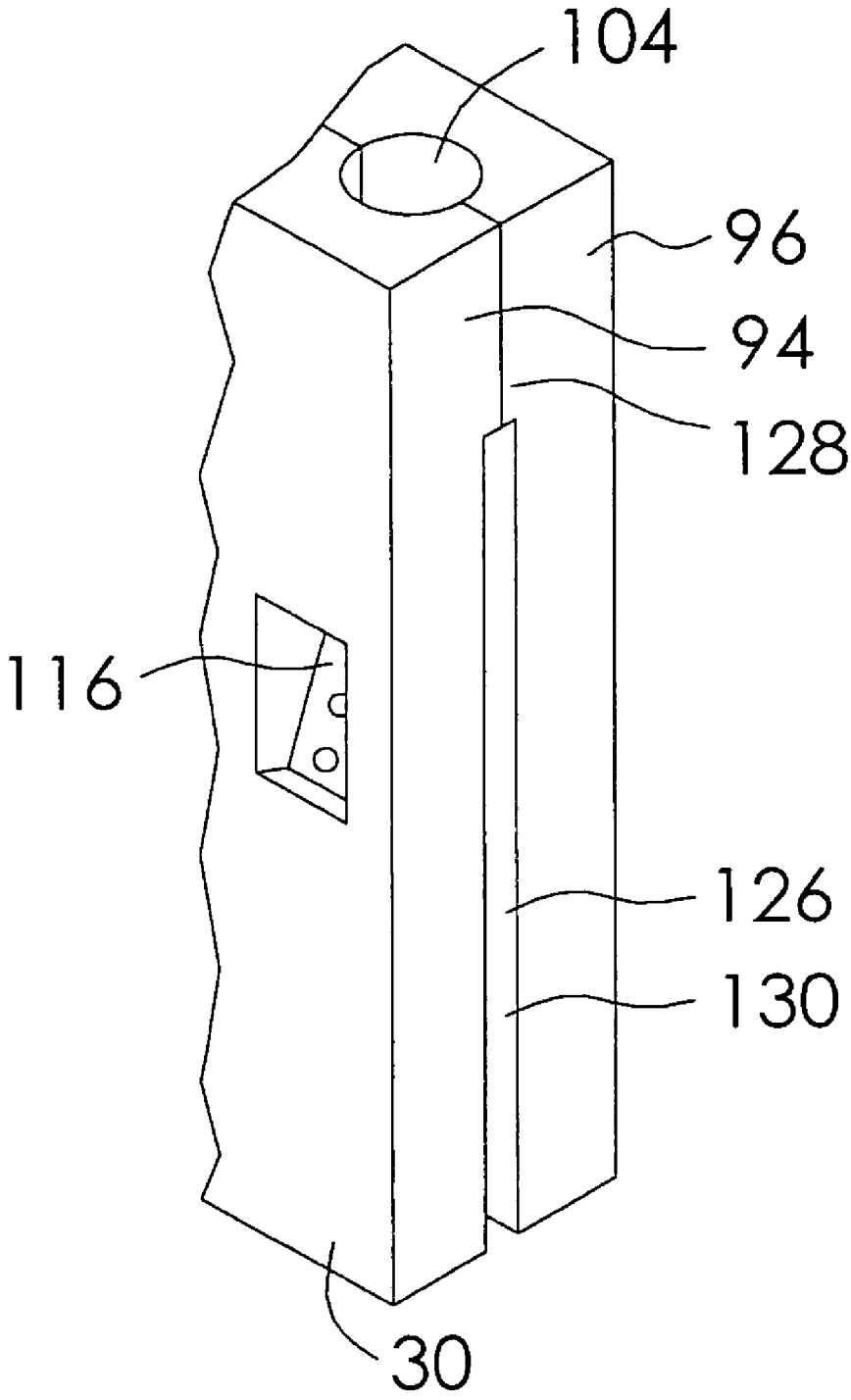
FIG. 11 is perspective view of a right side of the mandrel receptacle.
Figure 15:
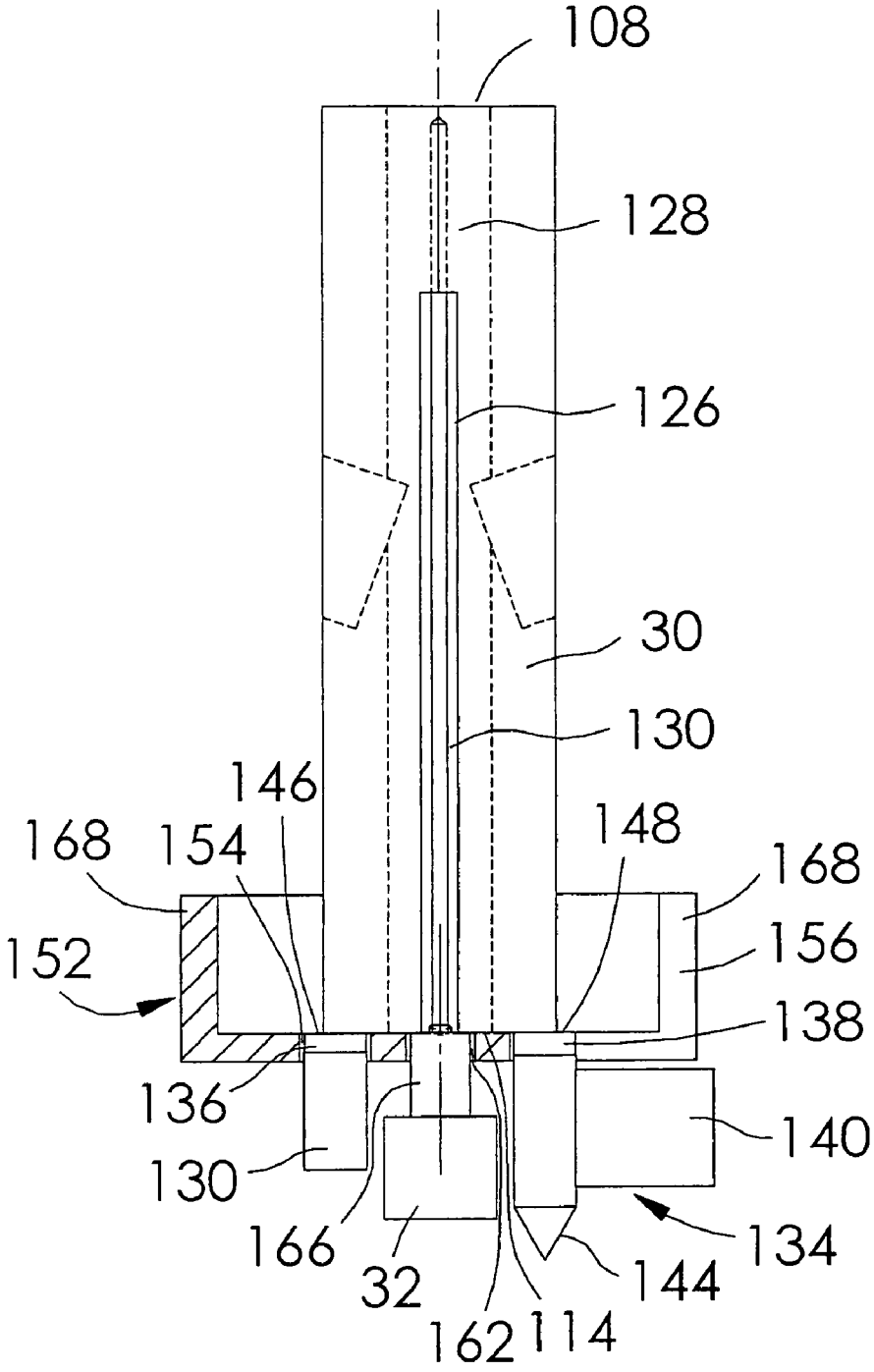
FIG. 15 is a view similar to FIG. 14, but showing the mandrel receptacle after it has rotated 90 degrees, on its way to rotating a full 180 degrees.

As shown in FIGS. 11 and 15, a slotted portion 126 and a closed portion 128 are provided along each side of the mandrel receptacle 30. Each slotted portion 126 extends from the bottom 114 of the mandrel receptacle 30 to the closed portion 128 which is on that respective side of the mandrel receptacle 30, and each closed portion 128 extends from the slotted portion 126 on that respective side of the mandrel receptacle 30 to the top 108 of the mandrel receptacle 30. Each slotted portion 126 provides that an opening 130 extends from the side of the mandrel receptacle 30 into the respective chamber from its side.

Figure 14:
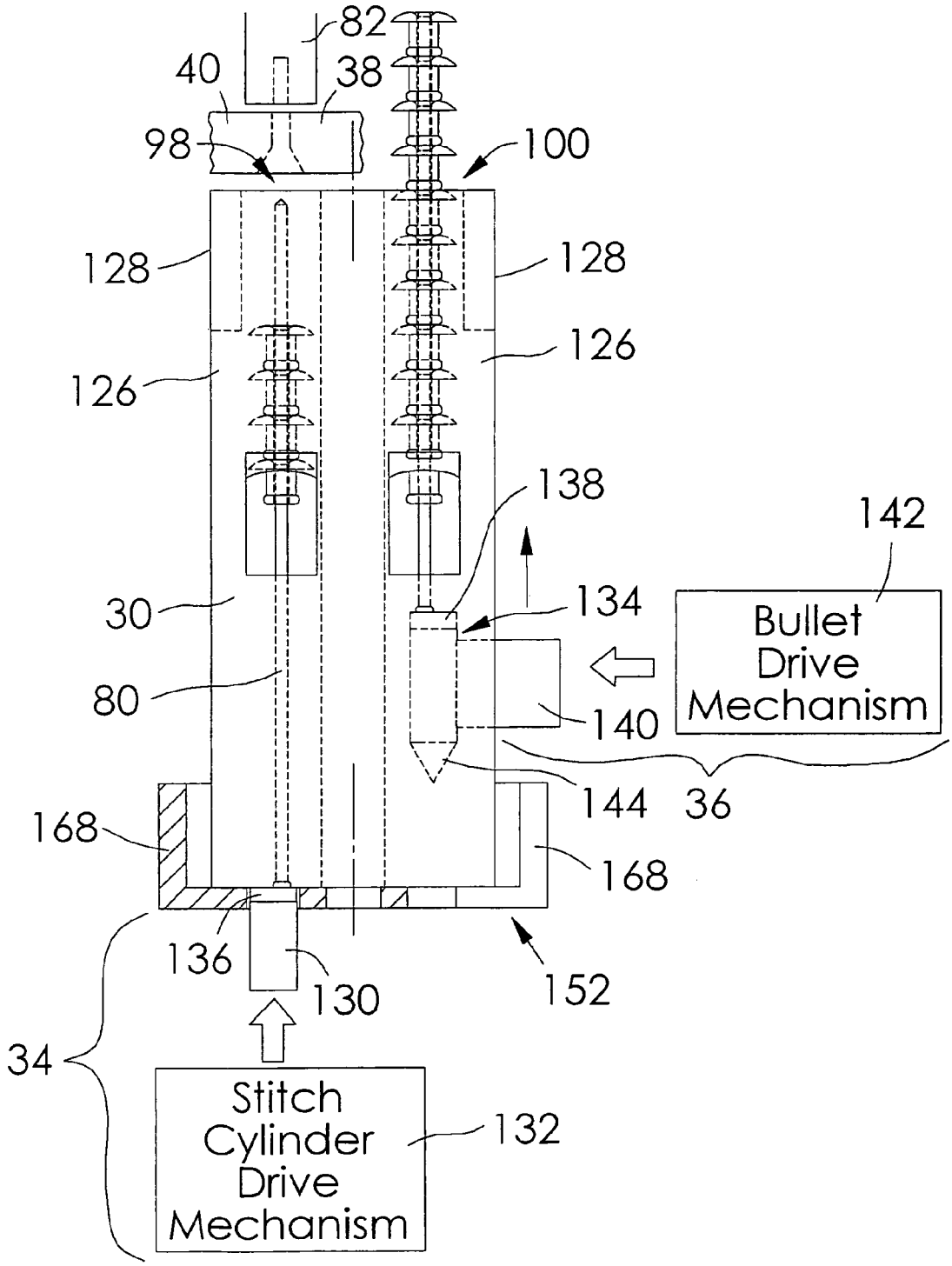
FIG. 14 is a front view of the mandrel receptacle, showing the mandrel receptacle disposed in a cup and showing the gripper components and pusher disposed above one of the chambers in the mandrel receptacle.

Mandrel drive mechanisms 34, 36 are provided to move mandrels in each of the two chambers 98, 100 provided in the mandrel receptacle 30. Specifically, as shown in FIG. 14, a first drive mechanism 34 includes a stitch cylinder 130 which enters and translates in the left-most chamber 98 (see FIGS. 10 and 12) through left-most hole 110 on the bottom 114 of the mandrel receptacle 30. The stitch cylinder 130 is connected to a stitch cylinder drive mechanism 132, such as an air cylinder with a relief valve, which is selectively controllable to move the stitch cylinder 130 up into the left-most chamber 98 in the mandrel receptacle 30.

Figure 16:
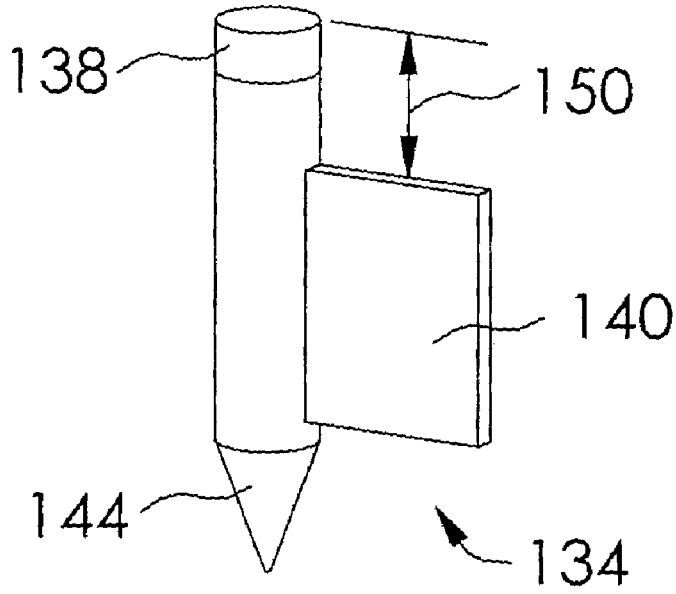
FIG. 16 is a perspective view of a bullet-shaped component of the automatic rivet loading module.

A second drive mechanism 36 includes a bullet-shaped member 134 which enters and translates in the right-most chamber in the mandrel receptacle 30 (see FIG. 14; see also FIG. 16 which shows the bullet-shaped member 134 isolated). Each of the stitch cylinder 130 and bullet-shaped member 134 has a magnetic end portion or a magnet 136, 138 at its end which is configured to magnetically attract a mandrel 80. A blade 140 extends from the bullet-shaped member 134 and is connected to a bullet drive mechanism 142, such as an air cylinder, which is selectively controllable to move the bullet-shaped member 134 into, and along (i.e., up and down therein), the right-most chamber 100 in the mandrel receptacle 30. Each of the slotted portions 126 in the mandrel receptacle 30 (along each side thereof) is configured to receive the blade 140 and allow the blade 140 to slide therein. The blade 140 extends from the side of the bullet-shaped member 134 and slides in the slotted portion 126 as the bullet-shaped member 134 translates in the chamber 100. The bullet drive mechanism 142 is configured to drive the bullet-shaped member 134 up and down, selectively, in the chamber 100 in the mandrel receptacle 30. As discussed, one end of the bullet-shaped member 134 provides a magnet or magnetic portion 138. The opposite end of the bullet-shaped member preferably provides a conical surface 144 or some other configuration which is configured to open the spring blades 116 when the bullet-shaped member 134 is moving downward, so the bullet-shaped member 134 can slide past the spring blades 116.

Preferably, the stitch cylinder 130 is moveable through a stroke distance wherein at the bottom of the stroke, the top edge 146 of the stitch cylinder 130 is flush with the bottom surface 114 of the mandrel receptacle 30 (see FIGS. 14 and 15), and at the top of the stroke, the stitch cylinder 130 is extended a desired distance into the mandrel receptacle 30, such that the top 92 of the mandrel 80 travels to a desired position.

Preferably, the bullet-shaped member 134 is moveable through a stroke distance wherein at the bottom of the stroke, the top edge 148 of the bullet-shaped member 134 is flush with the bottom surface 114 of the mandrel receptacle 30, and at the top of the stroke, the top edge 148 of the bullet-shaped member 134 is flush with the top surface 108 of the mandrel receptacle 30 and the blade 140 contacts the end of the slotted portion 126 (i.e., contacts the closed portion 128 on the side of the mandrel receptacle 30). As such, the distance 150 (see FIG. 16) from the top of the blade 140 to the end of the bullet-shaped member 134 (i.e., the end of the magnet or magnetic end portion 138) is approximately the same length as the length of the closed portions 128 which are provided on the sides of the mandrel receptacle 30.

Figure 18:
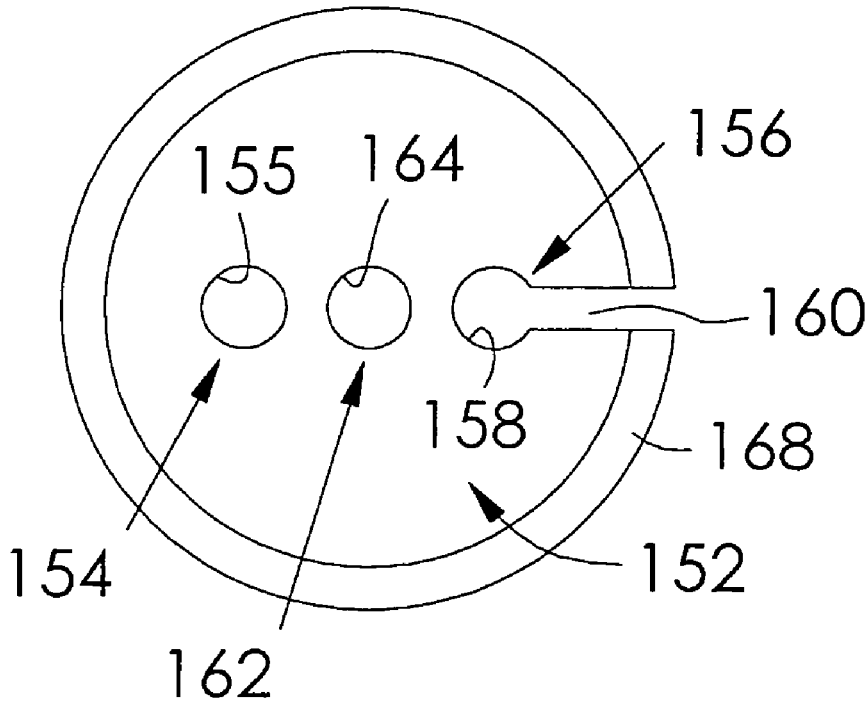
FIG. 18 is a top plan view of the cup shown in FIGS. 14 and 15.

As shown in FIGS. 14 and 15, the mandrel receptacle 30 is preferably rotatable and is positioned on, and in, a cup 152 (see also FIG. 18 which provides a top plan view of the cup, isolated). The cup 152 is preferably securely mounted to a support structure (not specifically shown) and includes: a first opening 154, perhaps in the form of a circular hole 155, through which the stitch cylinder 134 can pass; a second opening 156, perhaps in the form of a circular hole 158 and slot 160 extending therefrom, through which the bullet-shaped member 134 and blade 140 can pass, respectively; and a third opening 162, perhaps in the form of a circular hole 164 through which a shaft 166 from a rotary actuator 32 extends, wherein the shaft 166 connects the rotary actuator 32 to the mandrel receptacle 30, and the rotary actuator 32 is controllable to selectively rotate the mandrel receptacle 30, such as one hundred eighty degrees one way and the other.

As shown in FIG. 15, in addition to providing a stop for the stroke of the bullet-shaped member 134, the closed portions 128 in the sides of the mandrel receptacle 30 stabilize mandrels which are retained therein. The cup 152 in which the mandrel receptacle 30 is positioned includes an upwardly extending, circumferential side wall 168, and the wall also effectively provides a closed portion which functions to stabilize the mandrels which are retained in the mandrel receptacle 30, particularly when the mandrel receptacle is being rotated one hundred eighty degrees.

As discussed, preferably the rivet loading module 20 includes a tool activation device or block 37. Preferably, the tool activation block 37 is configured to receive the tool actuation module 24, and specifically the nose of the rivet gun, and sense when the tool actuation module 24 is received. Preferably, the tool activation block 37 includes one or more sensors which sense when the tool actuation module 24 is received.

Figure 17:
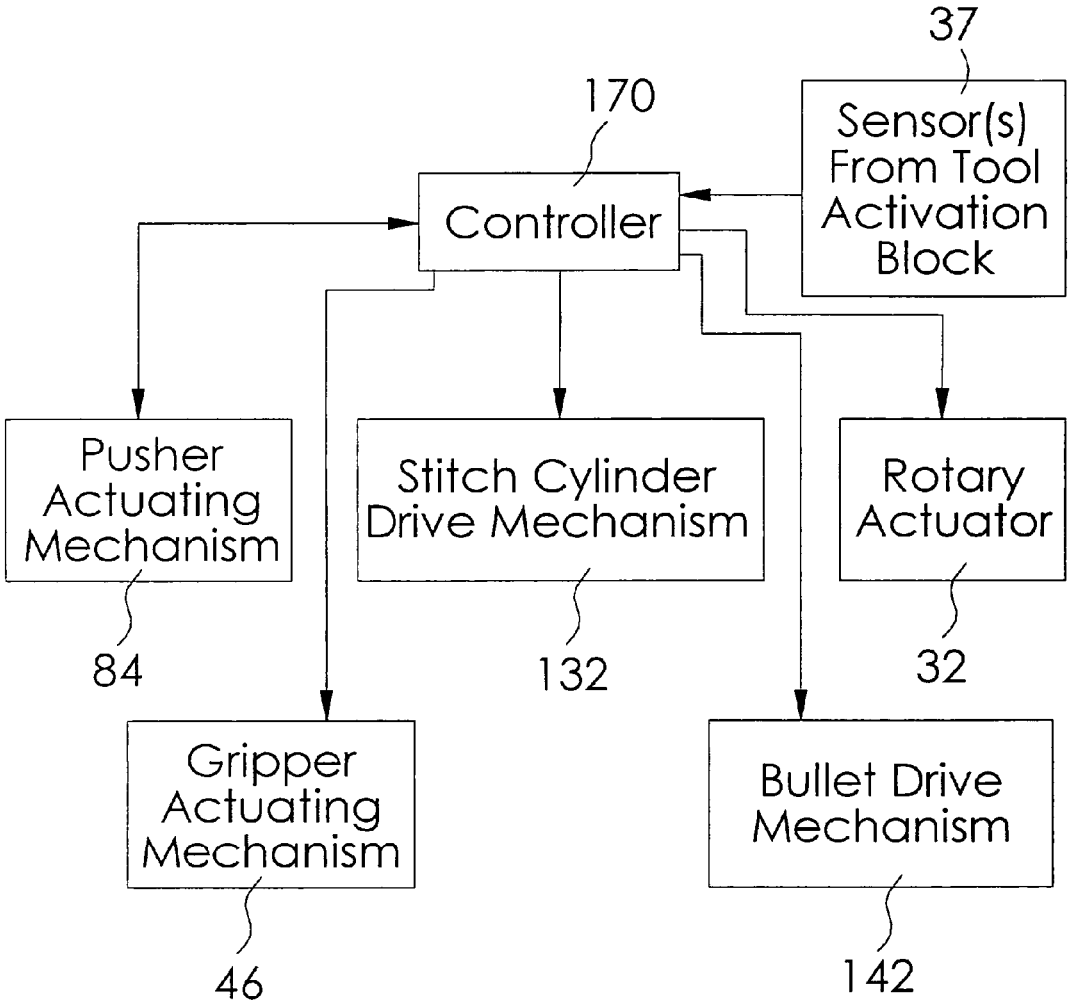
FIG. 17 is a block diagram of a control system which can be used to control the automatic rivet loading module shown in FIGS. 1 and 2.

FIG. 17 illustrates a control system which can be used to control the automatic rivet loading module 20. As shown, a controller 170 may be connected to the pusher actuating mechanism 84 such that the controller 170 can control the pusher mechanism 28 and receive feedback therefrom (i.e., whether the pusher 82 fails to travel through its entire downstroke). Additionally, the controller 170 is operably connected to the gripper actuating mechanism 46, the stitch cylinder drive mechanism 132, the bullet drive mechanism 142 and the rotary actuator 32 for rotating the mandrel receptacle 30. The controller 170 is preferably connected to the one or more sensors of the tool activation block 37, such that the controller 170 can determine when the tool actuation module 24 is received and control the components of the rivet loading module 20 accordingly. In this way, the automatic rivet loading module 20 is highly automated and controllable from a single controller 170.

Figure 8:
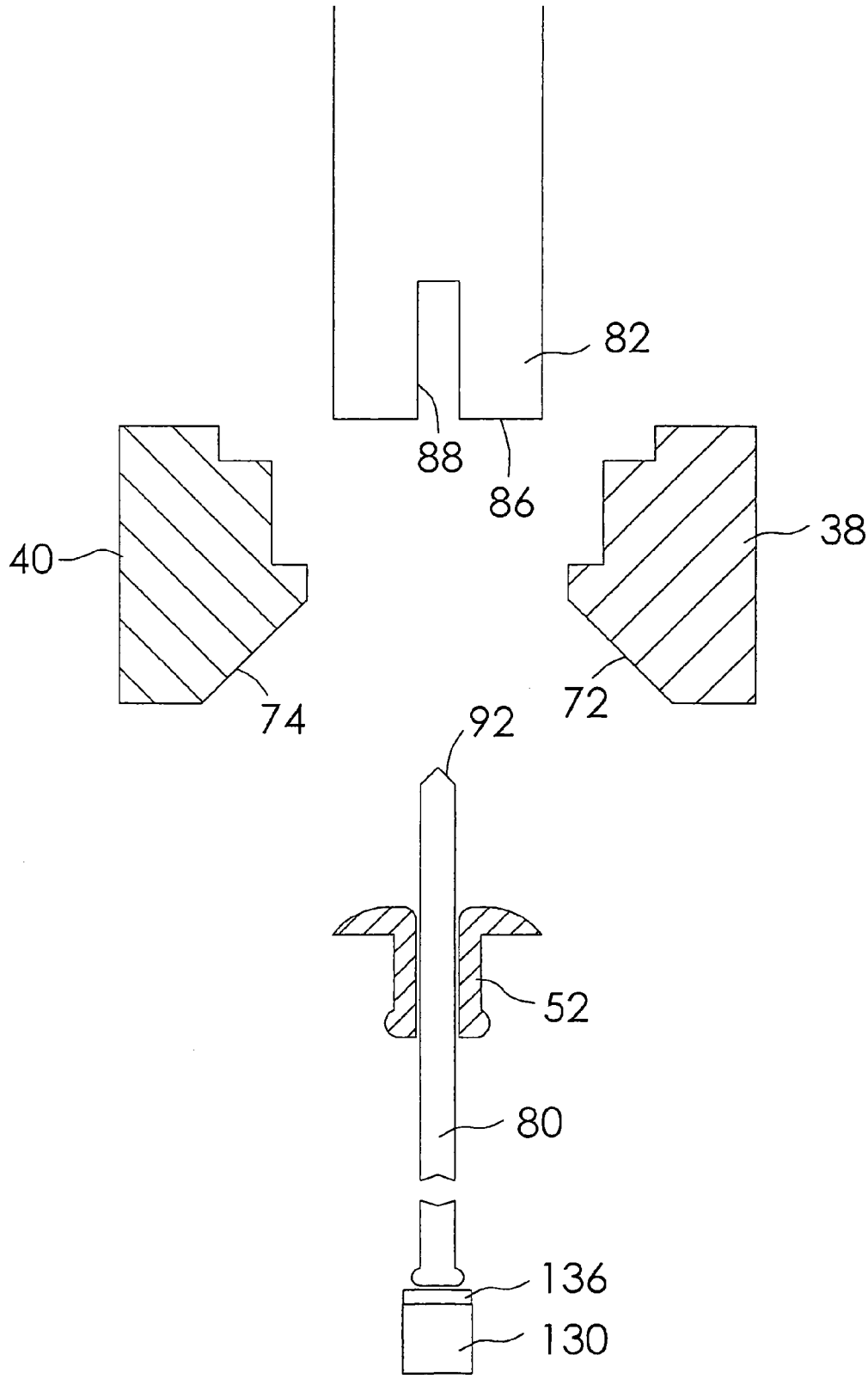
FIG. 8 is a view similar to FIG. 7, but showing the pusher retracted.
Figure 9:
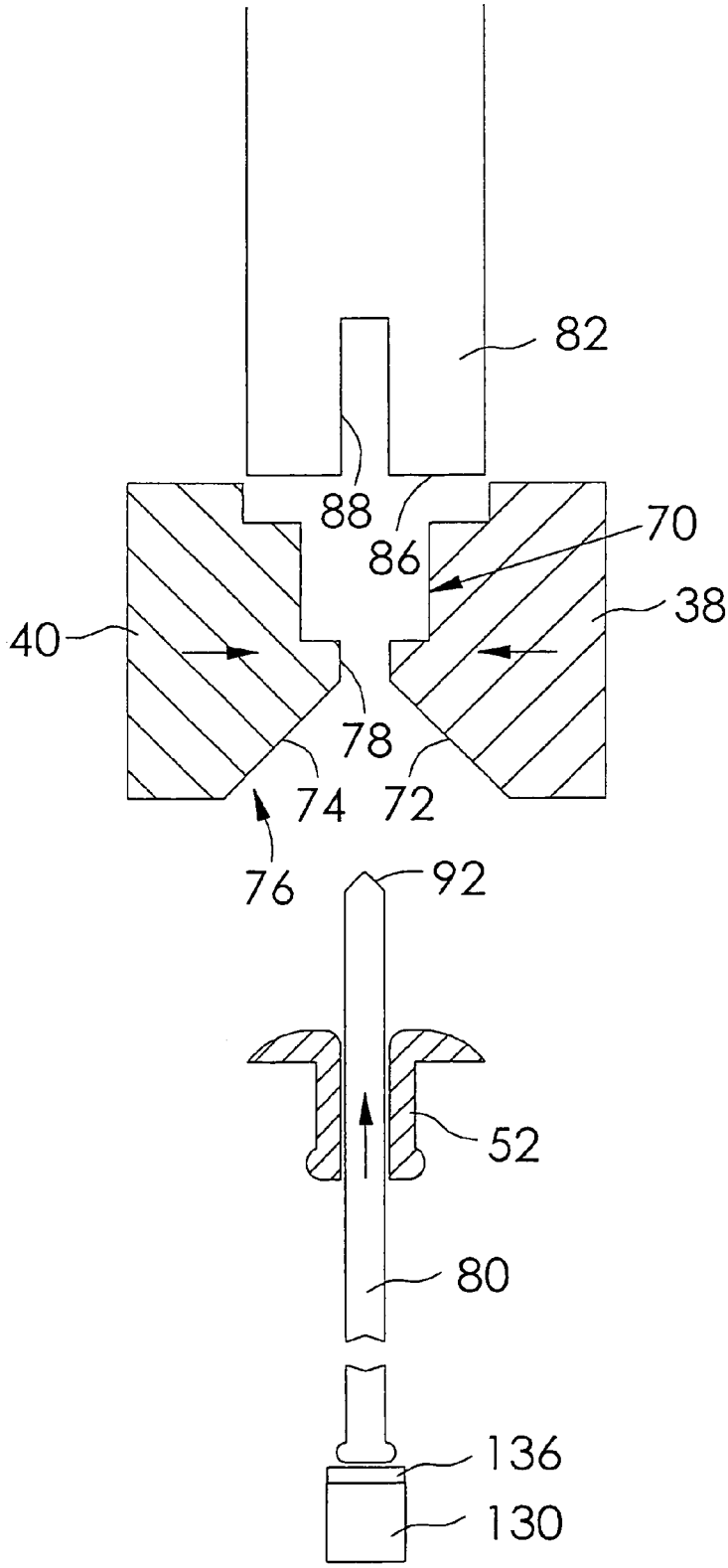
FIG. 9 is a view similar to FIG. 8, but showing the gripper components closed (i.e., pivoted together) to receive another rivet.

In operation, a rivet 52 is fed from the rivet feed module 22 to the gripper mechanism 26 as shown in FIG. 3. Specifically, the gripper components 38, 40 are pivoted closed, as shown in FIG. 4, as a rivet 52 is delivered to the rivet receptacle 58. When the rivet 52 is initially delivered to the gripper mechanism 26, the pusher 82 is in the up position and the mandrel 80 is down in the chamber 98 in the mandrel receptacle 30. Then, as shown in FIG. 5, the stitch cylinder 130 pushes the mandrel 80 up, into the lead cone 76, through the guide tube 78, through the rivet 52, and into the recess 88 in the end 86 of the pusher 82. Basically, the stitch cylinder 130 is moved to the end of its upward stroke, wherein the end of the upward stroke has been pre-selected to be such that the end 92 of the mandrel 80 moves to a desired position. Then, as shown in FIG. 6, the gripper components 38, 40 are opened (i.e., pivoted away from each other), and the pusher 82 moves the mandrel 80 downward as shown in FIG. 7, possibly also pushing the rivet 52 down on the mandrel 80 (if the rivet 52 did not already drop down the mandrel 80 as a result of gravity). Once the pusher 82 reaches the end of its stroke, it retracts upward as shown in FIG. 8, and the gripper components 38, 40 close again as shown in FIG. 9 to receive another rivet 52.

As rivets are threaded onto the mandrel 80 using the gripper mechanism 26 and pusher mechanism 28, eventually the mandrel 80 becomes full of rivets as shown in FIG. 13, at which time the bottom-most rivet in the chain contacts the blade springs 116 in the mandrel receptacle 30 and the top-most rivet in the chain is high enough that the pusher 82 cannot complete its down stroke. When the pusher 82 cannot complete its down stroke, the controller 170 which is connected to the pusher actuating mechanism 84 (see FIG. 17) senses as such, and determines that the mandrel is full. Preferably, the other chamber 100 in the mandrel receptacle 30 has an empty mandrel disposed therein, and the mandrel receptacle 30 is rotated 180 degrees such that the empty mandrel is positioned beneath the gripper mechanism 26 (see FIG. 4), and the full mandrel is positioned beneath the tool actuation module 24 (see FIG. 14). Then, as shown in FIG. 14, the bullet-shaped member 134 is moved upward to expel the full mandrel to the tool actuation module 24. Subsequently, the rivet gun (part of the tool actuation module 24) can be used to install the rivets which are disposed on the mandrel. When the rivet gun is being used, rivets can be installed on the empty mandrel in the opposite chamber 96 in the mandrel receptacle 30 as described above, using the gripper mechanism 26 and pusher mechanism 28. After all the rivets have been installed such that the mandrel in the rivet gun is empty again (or a different tool with an empty mandrel can be used), the empty mandrel is installed in the mandrel receptacle 30. To do so, the bullet-shaped member 134 is moved into the upmost position, wherein the end of the bullet-shaped member 134 (i.e., the magnet or magnetic portion thereof 138) is flush with the top 108 of the mandrel receptacle 30. The bullet-shaped member 134 is then moved downward while the magnet or magnetic portion 138 attracts the mandrel and pulls the mandrel down into the mandrel receptacle 30. Once the bullet-shaped member 134 has been moved to its down most position, wherein the top end of the bullet-shaped member 134 is flush with the bottom 114 of the mandrel receptacle 30, the mandrel receptacle can be rotated 180 degrees to move the empty mandrel under the gripper mechanism 26 and pusher mechanism 28, and move the full mandrel under the tool actuation module 24.

Figure 19:
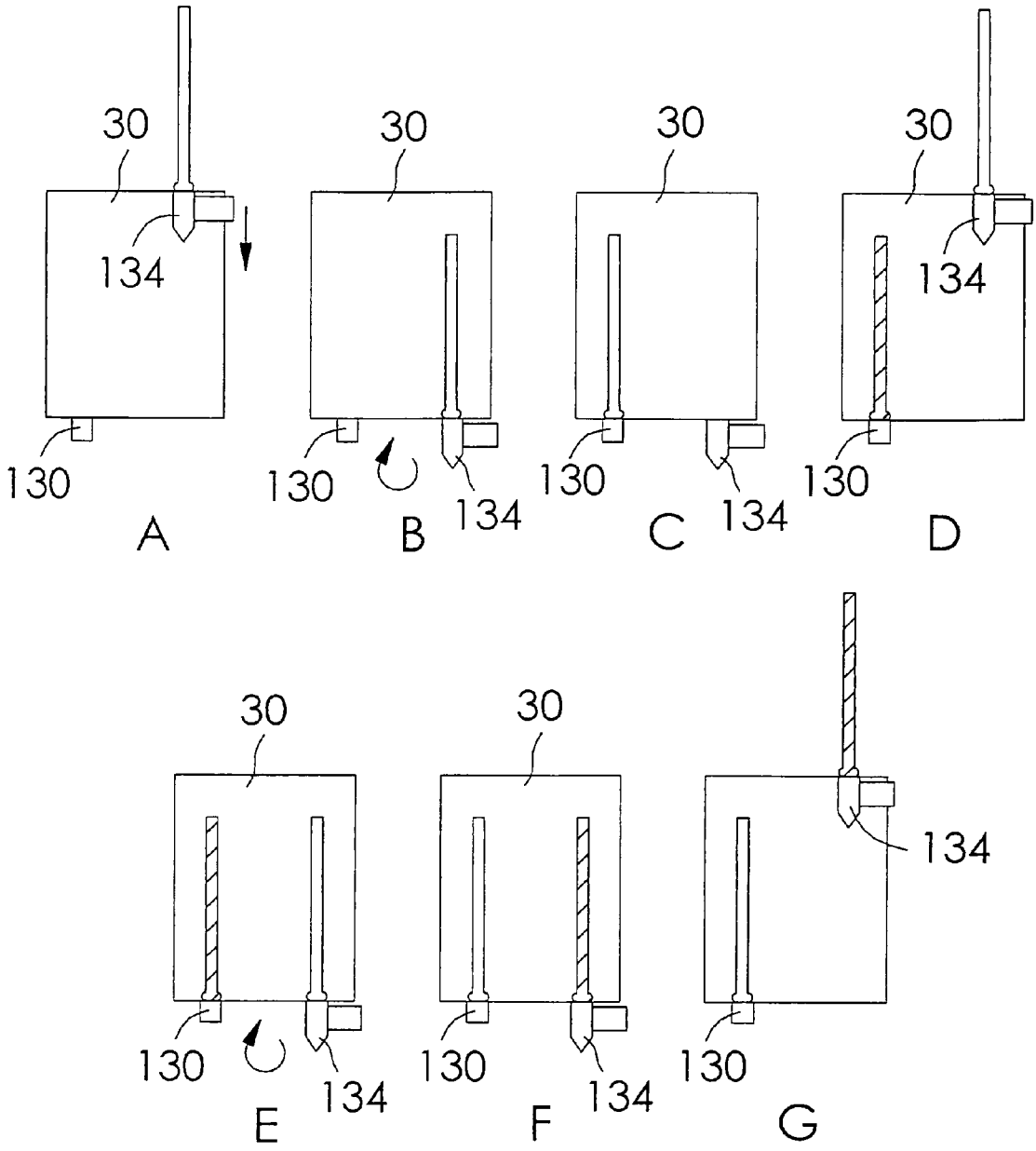
FIG. 19 is a series of views which show general operation of the automatic rivet loading module.

FIG. 19 provides a simplified series of views which illustrates the method of operation of the automatic rivet loading module. Initially, an empty mandrel is loaded into the right-most chamber of the mandrel receptacle using the bullet-shaped member 134. Specifically, the bullet-shaped member 134 is raised to its top-most position (view A in FIG. 19) and then is lowered to pull the mandrel into the mandrel receptacle 30 (view B in FIG. 19). Then, the mandrel receptacle 30 is rotated 180 degrees (to the position shown in view C in FIG. 19) and the mandrel is loaded with rivets as described above (view D in FIG. 19), using the gripper mechanism 26 and the pusher mechanism 28. Then, the bullet-shaped member 134 is raised (view D in FIG. 19) and lowered to pull another empty mandrel into the mandrel receptacle 30 (view E in FIG. 19). Then, the mandrel receptacle 30 is rotated 180 degrees (to the position shown in view F in FIG. 19), and the bullet-shaped member 134 is raised to expel the full mandrel (view G in FIG. 19). While the full mandrel is being expelled, or after the full mandrel has been expelled, rivets can be loaded onto the empty mandrel as described above (view D in FIG. 19), using the gripper mechanism 26 and the pusher mechanism 28. Thereafter, another empty mandrel can be installed in the mandrel receptacle 30 (i.e., the progression from view D to view E in FIG. 19), and the process repeated.

The automatic rivet loading module which has been described is fully automatic, highly reliable, lightweight and very fast. It is preferably configured to provide that twelve inches of rivets (such as forty to sixty rivets, depending on length) can be inserted into a rivet tool (i.e., in a rivet actuation module) in four to six seconds. As such, the automatic rivet loading module allows an operator to make more joint fastenings in a given amount of time, compared to a typical rivet loading mechanism. Additionally, the rivet loading module is configured such that a mandrel can be loaded with rivets while the rivet gun is being used elsewhere.

While an embodiment of the present invention is shown and described, it is envisioned that those skilled in the art may devise various modifications of the present invention without departing from the spirit and scope of the disclosure.

What is claimed is:

1. A method of using an automatic rivet loading module to load rivets on a mandrel, said method comprising: closing a gripper mechanism of the module; providing a rivet to the gripper mechanism; positioning a first chamber of a mandrel receptacle of the module proximate the gripper mechanism, said first chamber having a mandrel disposed therein, using a pusher mechanism of the module to push the mandrel through the rivet in the gripper mechanism; opening the gripper mechanism; using another pusher mechanism of the module to push the mandrel down in the first chamber; moving the mandrel receptacle such that the first chamber becomes positioned proximate a mechanism for urging the mandrel out the mandrel receptacle; and using the urging mechanism to urge the mandrel out the mandrel receptacle.

2. A method of loading rivets on a mandrel as recited in claim 1, wherein the step of moving the mandrel receptacle such that the first chamber becomes positioned proximate said mechanism for urging the mandrel out the mandrel receptacle further comprises moving the mandrel receptacle such that a second chamber becomes positioned proximate said gripper mechanism, said second chamber having a mandrel disposed therein.

3. A method of loading rivets on a mandrel as recited in claim 1, said step of opening the gripper mechanism comprises pivoting a pair of gripper components relative to each other.

4. A method of loading rivets on a mandrel as recited in claim 1, said step of moving the mandrel receptacle comprising rotating said mandrel receptacle.

5. A method of loading rivets on a mandrel as recited in claim 1, said step of moving the mandrel receptacle comprising rotating said mandrel receptacle in a cup.

6. A method of loading rivets on a mandrel as recited in claim 1, further comprising using spring blades to prevent rivets from moving too far along a mandrel in the mandrel receptacle.

7. A method of loading rivets on a mandrel as recited in claim 1, further comprising using a stitch cylinder to move the mandrel through the rivet.

8. A method of loading rivets on a mandrel as recited in claim 1, further comprising using a bullet-shaped member to urge the mandrel out the mandrel receptacle.

* * * * *